United States Patent [19]

Braceland

[11] 4,383,680

[45] May 17, 1983

[54] JIG FOR ASSEMBLING TABLE TOPS

[76] Inventor: Richard Braceland, Box 7793, Barry's Bay, Ontario, Canada, K0J 1B0

[21] Appl. No.: 210,173

[22] Filed: Nov. 25, 1980

[51] Int. Cl.[3] ..... B25B 1/20

[52] U.S. Cl. ..... 269/43; 269/905; 269/910

[58] Field of Search ..... 29/281.1, 281.3; 227/152, 154, 155; 100/913; 269/910, 905, 43, 41, 37, 254 CS, 208

[56] References Cited

U.S. PATENT DOCUMENTS

| | | | |
|---|---|---|---|
| 1,068,923 | 7/1913 | Palmer | 269/910 |
| 4,154,436 | 5/1979 | Sellers | 269/910 |
| 4,235,005 | 11/1980 | James | 227/152 |

*Primary Examiner*—Robert C. Watson

*Attorney, Agent, or Firm*—Burke-Robertson, Chadwick & Ritchie

[57] ABSTRACT

A jig for assembling table tops such as picnic table tops, which have a plurality of similar elongated rectangular top members secured together in aligned fashion on transverse bottom members. The jig comprises a frame to which are secured transverse member holders having bottom and side surfaces to receive and secure in parallel position at predetermined spaced locations the transverse members in such a way that the upper surfaces of the transverse members in position in the transverse member holders lie in the same plane. The jig also comprises alignment means secured to the frame to align one end of the top members when in assembly position on the transverse members in the transverse member holders. An alignment means is rigidly secured to the frame at a position which will properly orient a top member with respect to the transverse member by abutment of one of the top member's side surfaces against this alignment means. In instances where spaced top members are required for the table, spacer pins are provided of a diameter similar to the desired spacing between adjacent top members. These pins are laterally moveable in channels secured to the frame so that a pin is received towards each end between the sides of each pair of adjacent top members. The jig is provided with a pair of clamping jaws movable laterally in the assembly plane of the top members and means to move the clamping jaws to bear against the outer sides of the outer top members and to move the top members transversely into final assembly position and hold them in that position for assembly. The jig according to the present invention partially automates what has previously been a strictly manual job of aligning and securing top table members to transverse members.

12 Claims, 4 Drawing Figures

JIG FOR ASSEMBLING TABLE TOPS

BACKGROUND OF THE INVENTION

This invention relates to a jig for assembling table tops such as picnic table tops.

Apparatus or jigs for aligning and holding in place construction elements during assembly operations are known in the art. Such devices have been developed for fabrication of wall frames for buildings (e.g. U.S. Pat. No. 3,680,617, Schneider, issued Aug. 1, 1972; U.S. Pat. No. 3,299,920, Koenigshof, issued Jan. 24, 1967, and U.S. Pat. No. 2,322,368, Lacey, issued June 22, 1943), and for construction of cabinets (e.g. U.S. Pat. No. 3,665,986, Johnson, issued May 30, 1972; Canadian Pat. No. 223,997, Krueger, issued Sept. 26, 1922). Canadian Pat. No. 1,043,548, Lacasse, issued Dec. 5, 1978, describes and illustrates apparatus for manufacturing curved seats.

None of these previously described devices suggests a solution to the problem of mechanically aligning the transverse and elongated rectangular top members which, when secured, will form a table top such as, for example, a picnic table top, and retaining them in position for assembly with appropriate securing means.

Heretofore, the transverse and elongated rectangular top members of such a table construction have usually been secured together as a strictly manual operation to form the table top, this operation being carried out either at a table manufacturing plant or at the site where such a table is to be used. In this latter case, the elements making up the table are packaged in separated form at the factory and sold, as a kit, to the customer who then assembles the table at his home or on site. Such manual assembly of the entire table is a time consuming operation. In addition, the final, assembled product is often irregular in shape because of uneven alignment of the ends of the top members of the table, irregular spacing between such top members or irregular placing of the securing screws or nails in the top members by the customer.

SUMMARY OF THE INVENTION

According to the present invention, a jig is provided for assembling table tops such as picnic table tops, which have a plurality of similar elongated rectangular top members secured together in aligned fashion on transverse bottom members. The jig comprises a frame to which are secured transverse member holders having bottom and side surfaces. These transverse member holders receive and hold in parallel position at predetermined spaced locations the transverse members so that the upper surfaces of the transverse members are located above the side surfaces of the respective transverse member holders and lie in the same plane. The jig also comprises alignment means secured to the frame to align one end of the top members when they are in assembly position on the transverse members in these transverse member holders. A lateral alignment means is rigidly secured to the frame at a position and in an orientation which will properly position and orient a top member with respect to the transverse member by abutment of one of the top member's side surfaces against this alignment means. The jig is provided with a pair of clamping jaws movable laterally in the assembly plane of the top members and means to move the clamping jaws to bear against the outer sides of the outer top members, and to move the top members transversely into final assembly position and hold them in that position for assembly, and thereafter to move the jaws apart from assembly position to permit removal of an assembled top. In instances where spaced top members are required for the table, spacer pins are provided of a diameter similar to the desired spacing between adjacent top members. These pins are laterally moveable in channels secured to the frame so that a pin is received towards each end between the sides of each pair of adjacent top members to be assembled.

The jig according to the present invention is also preferably further provided with a means to indicate on the upper surface of the top members when in assembly position a pattern for locating securing means such as screws and nails, to secure the top and transverse members together. This means may, for example, be a rigid grid pivotably secured to the frame to pivot onto the upper surface of the top members when in assembly position. Such a grid is provided with holes positioned to constitute the securing means pattern, which holes are of a diameter sufficient to receive and pass the heads of the securing screws or nails.

The jig according to the present invention permits fast and accurate assembly of top and transverse members to form the top of a table such as a picnic table at the factory. The assembled table top may be packaged together with unassembled legs and securing means for the legs to form an easily transportable unit for shipping to customers. Of course, since the most visible part of the table, the top, is preassembled with aligned, evenly positioned or spaced top members, the purchaser who assembles such a table top on table legs is provided with an attractive, professional looking final product. Such a final product is also more readily constructed having regard to the fact that the top has been pre-assembled.

BRIEF DESCRIPTION OF THE DRAWINGS

These and other objects and advantages of the present invention will be more fully understood by referring to the accompanying drawings.

DETAILED DESCRIPTION OF THE DRAWINGS

Figure 1:
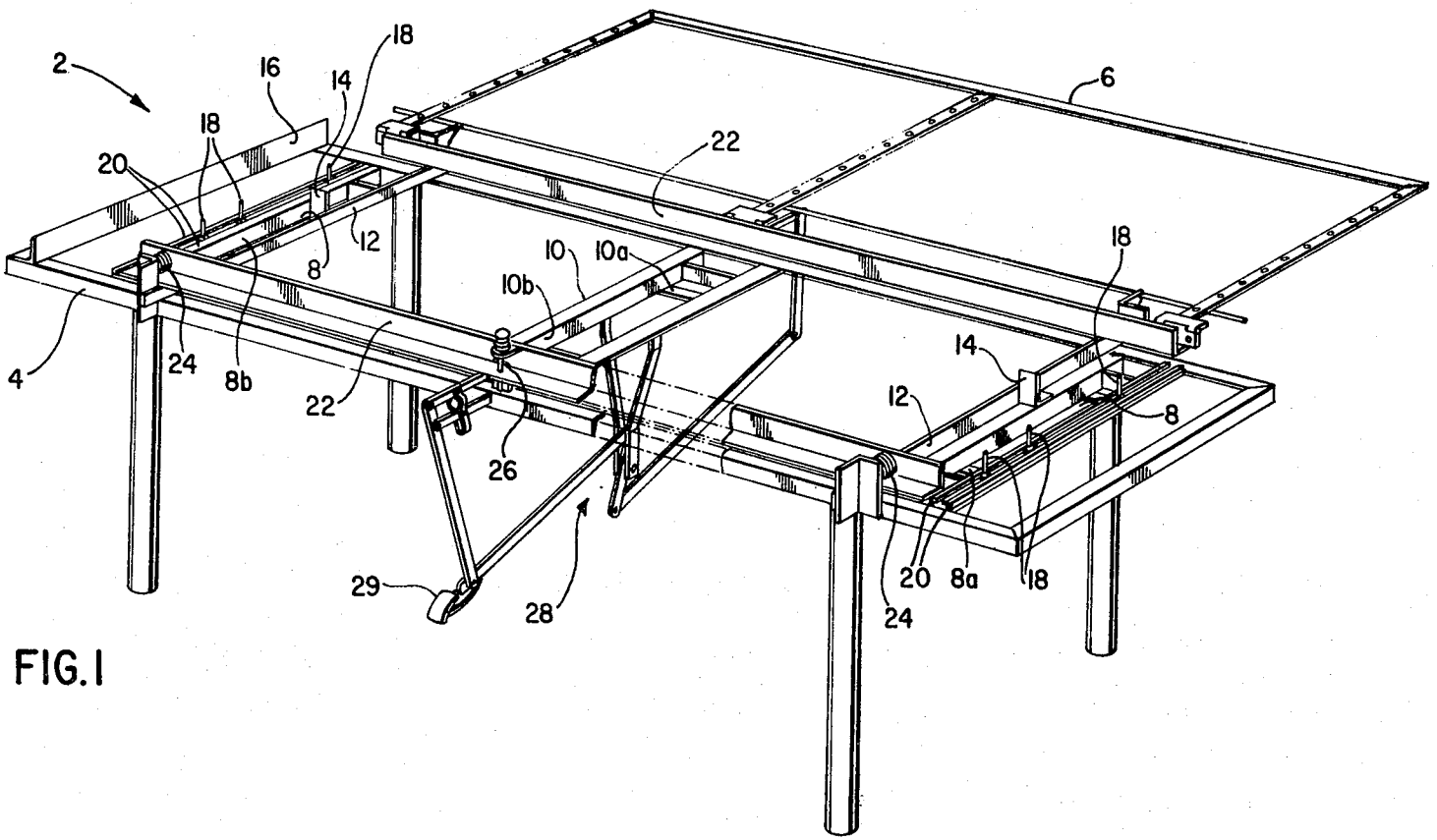
FIG. 1 is a perspective view of a jig according to the present invention having a screw pattern grid in open position, and clamping jaws similarly restrained in open position.

In the drawings similar features have been given similar reference numerals. Turning to FIG. 1 there is shown a jig 2 comprising main frame 4 to which is pivotably secured a securing means pattern 6 (shown here in open position).

To frame 4 are secured header holders 8 and center cleat holder 10 to hold these transverse members of the table top in position for assembly. Holders 8 and 10 are provided with bottom surfaces 8*a* and 10*a* respectively and side surfaces 8*b* and 10*b* respectively which receive and secure in position at predetermined spaced locations with respect to frame 4 the transverse members of the table and ensure that the upper surfaces of these transverse members, when in position in these holders, lie in the same plane.

Frame 4 is further provided with clamp slide bars 12 which support clamping jaws 22 during operation of the jig. On slide bars 12 are secured lateral alignment means (spacer) 14 comprising elongated tabs of a lateral thickness similar to the desired space between adjacent top members. It can be seen that these tabs are longitudinally aligned, and will extend into the assembly plane of the top members. They are precisely positioned with respect to frame 4 so that top members with their side surfaces abutting against the elongated sides of these tabs will be properly laterally aligned and positioned with respect to the transverse member (leaders and cleat).

Transverse squaring bar 16 is secured to one end of jig 4 so that when corresponding ends of top members are in abutting position against this bar, they are aligned and in position with respect to their ends for assembly to the transverse members.

Spacer pins 18, each having a diameter similar to the desired spacing between adjacent top members, are provided, being movable on bases held in channels 20 which channels are secured transversely to frame 4. Spacer pins 18, in channels 20, are of a height which extends into the space between adjacent top members during assembly but not beyond that upper surface of such top members during assembly, to facilitate removal of the assembled table top from these pins.

Figure 2:
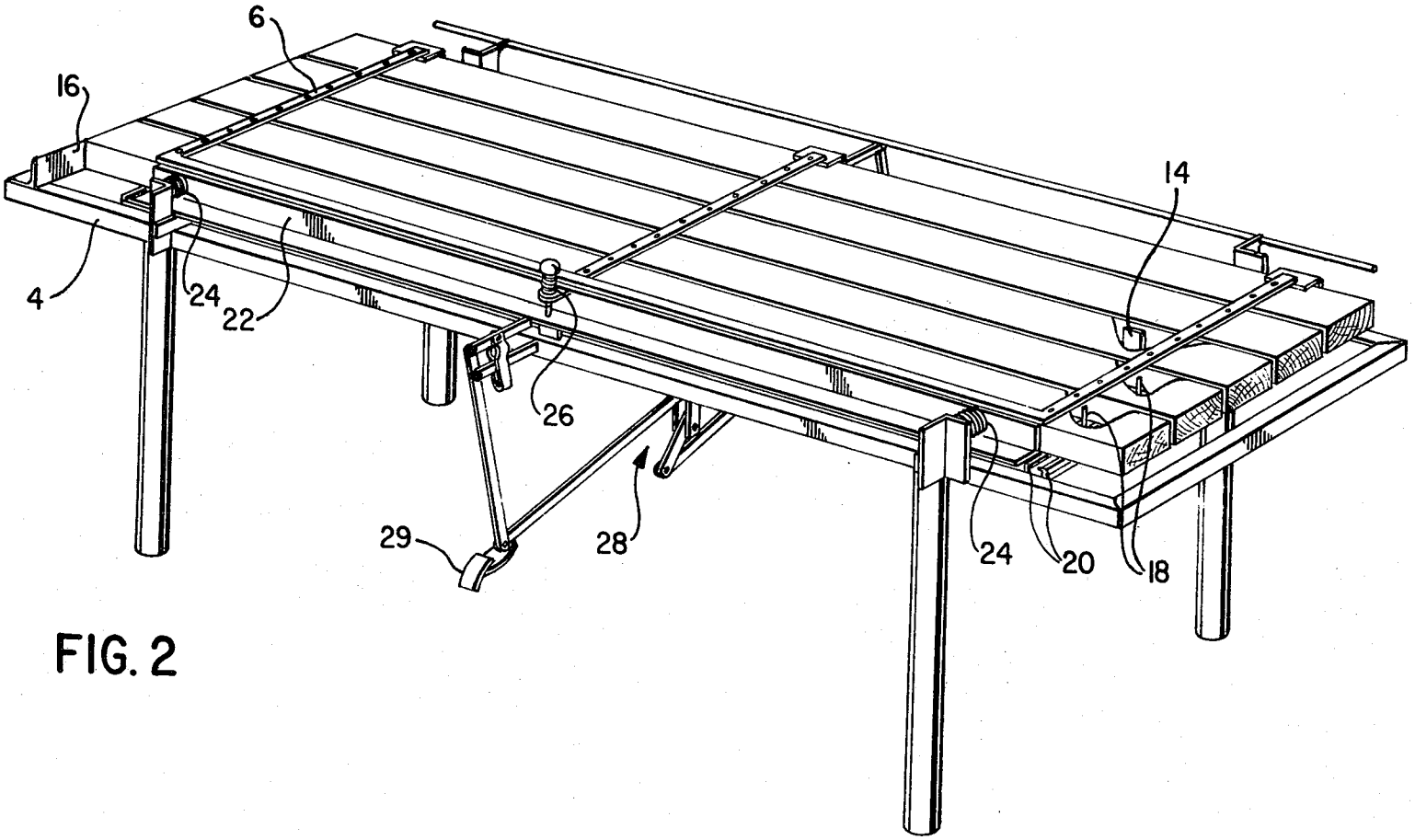
FIG. 2 is a similar view of the jig of FIG. 1 with the jaws in assembly position bearing against the top members, and with the screw pattern grid in assembly position on the upper surface of the top members.
Figure 3:
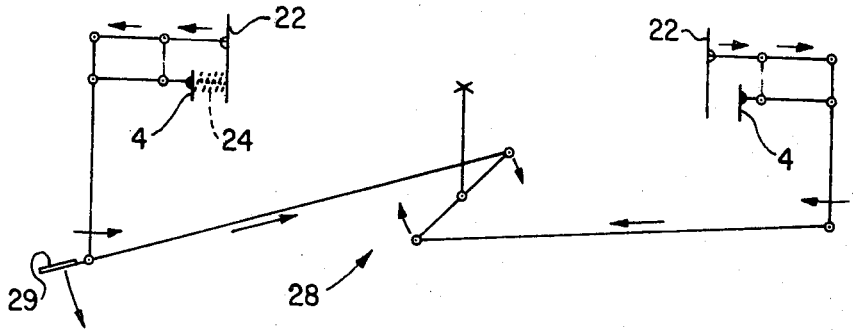
FIG. 3 is a schematic view of a mechanism to move the clamping jaws.
Figure 4:
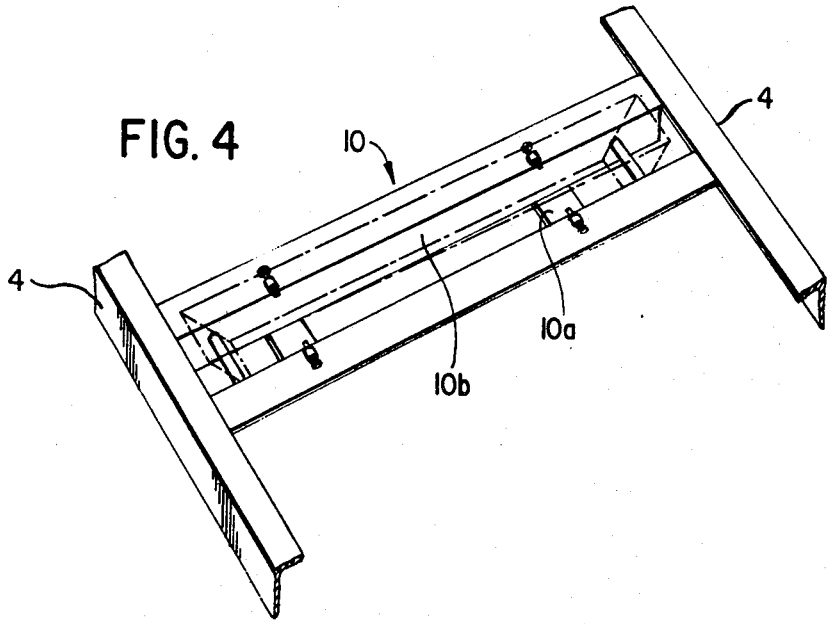
FIG. 4 is a detail view of a transverse member holder in a jig according to the present invention.

Clamping jaws 22 are moveably secured to jig 2 for movement in the assembly plane of top members. In open position, shown in FIG. 1, jaws 22 are held in this position against the urging of springs means 24 by releasable stop means 26. The jaws in this position permit loading of transverse and top members into the jig unobstructed by the jaws. Movement means 28, shown in detail in FIG. 3, enables simultaneous and similar transverse movement of jaws 22 together to bear against the outer sides of outer top members (as shown in FIG. 2), to move these top members transversely together into final assembly position, and to hold them in that position for assembly. The mechanism shown enables jaws 22 to move horizontally, a similar distance, in opposite directions. Jaws 22 are supported during movement on slide bar 12. Movement of the jaws takes place under the inward bias provided by spring means 24. As seen in FIG. 3, application of pressure to foot pedal 29 causes these jaws to move apart against the bias of spring means 24 to a position where stop 26 can be activated to hold the jaws in open position for removal of an assembled top.

In operation, with jaws 22 held in open position by stop 26, precut headers and a center cleat are positioned in holders 8 and 10 respectively. A first, precut elongated rectangular top member is placed in position aligned longitudinally from the transverse members to one side of spacer 14, and another top member similarly generally positioned on the transverse members on the other side of spacer 14. The remaining top members of the table are generally positioned on the transverse members between clamping jaws 22 with a spacer pin 18 in each channel 20 situated between adjacent top members. The top members are moved into abutting alignment against squaring bar 16, and stop 26 is then released so that clamping jaws 22 are forced against the outer sides of the outer top members and move these and the remaining top members into final, aligned assembly position. Grid 6 containing the screw pattern is then swung into position on the upper surface of these top members so that nails or screws can be passed through the holes in the grid to secure the top members to the transverse members. As can be seen in FIG. 1, grid 6 is secured to one jaw 22. This construction permits limited play in the grid during the securing operation, thereby assisting the assembly operation. For instance, where a screw or nail would pass through a knot in the wood in normal grid pattern position, the grid can then be moved slightly so that the knot may be avoided.

Once the assembling operation has been completed, grid 6 is swung back into open position (FIG. 1), pedal 29 is depressed to open clamping jaws 22, stop 26 is activated to secure the clamping jaws in open position, and the assembled table top is removed from the jig. The operation is repeated for assembly of further table tops. Two men operating the jig can completely assemble a table top in under two minutes.

It should be noted that the jig may be used to construct table tops with laterally abutting top members by not using the spacer pins 18 or spacer 14.

As an alternative, it will be noted that instead of a rigid pivoting grid, the securing means pattern may be provided on the top upper surface of the top members in assembly position by means of a light pattern which is properly positioned with respect to the jig frame to illuminate the proper locations of the securing means.

While the invention has been described in detail in respect of the preferred embodiments, it will be understood that it is not intended to limit the invention to those embodiments. On the contrary it is intended to cover all alternatives, modifications and equivalents as may be included within the spirit and scope of the present invention.

What I claim as my invention:

1. A jig for assembling table tops having a plurality of similar, elongated rectangular members secured together in aligned fashion on transverse bottom members, the jig comprising:

(a) a frame;

(b) transverse member holders secured to the frame and having bottom and side surfaces to receive and secure in parallel position at predetermined spaced locations the transverse members, the upper surfaces of the transverse members located above the side surfaces of the respective member holders at similar heights, whereby the upper surfaces of the transverse members in position in the transverse member holders lie in the same plane;

(c) alignment means secured to the frame to align one end of the top members when in assembly position on the transverse members in the transverse member holders;

(d) lateral alignment means rigidly secured to the frame at a position and in an orientation which will properly position and orient a top member with respect to its intended longitudinal axis and with respect to the transverse members, the lateral alignment means comprising two or more spaced tabs of a thickness similar to the desired spacing between adjacent top members, the tabs being longitudinally aligned in the assembly plane of the top members and precisely positioned with respect to the frame so that adjacent top members with their side surfaces abutting against the elongated sides of the tabs will be properly longitudinally oriented and laterally aligned and positioned with respect to the transverse members;

(e) clamping jaws secured to the frame, each being movable transversely with respect to the frame in the assembly plane of the top members;

(f) means to move the clamping jaws to bear against the outer sides of the outer top members, to move the top members transversely into final assembly position, and to hold them in that position for assembly, and thereafter to move the jaws apart from assembly position to permit removal of an assembled top.

2. A jig according to claim 1, further comprising spacer pins of a diameter similar to a desired spacing between adjacent top members and laterally moveable in channels secured to the frame so that a pin may be received towards each end between the sides of each pair of adjacent top members.

3. A jig according to claim 2, further comprising a means to provide on the upper surface of the top members when in assembly position a pattern for locating securing means for the top and transverse members.

4. A jig according to claim 1, further comprising a rigid planar grid pivotably secured to the frame to pivot onto the upper surface of the top members when in assembly position, the grid being provided with holes positioned to constitute the securing means pattern and of a diameter sufficient to receive and pass a head of a securing screw or nail for the top and transverse members.

5. A jig according to claim 1, wherein biasing means are provided on the frame to urge the jaws into assembly position, and a releasable stop means is associated with the jaws and frame to hold the jaws in open position against the urging of the biasing means to permit loading of the transverse and top members into the jig, unobstructed by the jaws.

6. A jig according to claim 4, wherein the grid is pivotably secured to one of the jaws.

7. A jig according to claim 2, wherein the spacer pins are of a location and height to extend into the space between adjacent top members during assembly but not beyond the upper surface of such top members.

8. A jig according to claim 1, wherein the lateral alignment means comprises a pair of longitudinally oriented spacer bars secured in the assembly plane of the top members whereby a pair of the top members is laterally positioned and longitudinally aligned by abutment of their confronting side against these bars.

9. A jig according to claim 1, wherein the alignment means comprises a bar in the assembly plane of the top members transversely extending across the frame at one end, whereby one end of the top members is aligned by abutment against this bar.

10. A jig for assembling table tops having a plurality of similar, elongated rectangular members secured together in aligned fashion on traverse bottom members, the jig comprising:

(a) a frame;

(b) transverse member holders secured to the frame and having bottom and side surfaces to receive and secure in parallel position at predetermined spaced locations the transverse members, the upper surfaces of the transverse members located above the side surfaces of the respective transverse member holders at similar heights, whereby the upper surfaces of the transverse members in position in the transverse member holders lie in the same plane;

(c) alignment means secured to the frame to align one end of the top members when in assembly position on the transverse members in the transverse member holders;

(d) lateral alignment means rigidly secured to the frame at a position and in an orientation which will properly position and orient a top member with respect to its intended longitudinal axis and with respect to the transverse members by abutment of one of that top members's side surfaces against the alignment means;

(e) clamping jaws secured to the frame, each being movable transversely with respect to the frame in the assembly plane of the top members;

(f) means to move the clamping jaws to bear against the outer sides of the outer top members, to move the top members transversely into final assembly position, and to hold them in that position for assembly, and thereafter to move the jaws apart from assembly position to permit removal of an assembled top; and (g) means to provide on the upper surface of the top members when in assembly position a pattern for locating securing means for the top and transverse members.

11. A jig for assembling table tops having a plurality of similar, elongated rectangular members secured together in aligned fashion on traverse bottom members, the jig comprising:

(a) a frame;

(b) transverse member holders secured to the frame and having bottom and side surfaces to receive and secure in parallel position at predetermined spaced locations the transverse members, the upper surfaces of the transverse members located above the side surfaces of the respective transverse member holders at similar heights, whereby the upper surfaces of the transverse members in position in the transverse member holders lie in the same plane;

(c) alignment means secured to the frame to align one end of the top members when in assembly position on the transverse members in the transverse member holders;

(d) lateral alignment means rigidly secured to the frame at a position and in an orientation which will properly position and orient a top member with respect to its intended longitudinal axis and with respect to the transverse members by abutment of one of that top members's side surfaces against the alignment means;

(e) clamping jaws secured to the frame, each being movable transversely with respect to the frame in the assembly plane of the top members;

(f) means to move the clamping jaws to bear against the outer sides of the outer top members, to move the top members transversely into final assembly position, and to hold them in that position for assembly, and thereafter to move the jaws apart from assembly position to permit removal of an assembled top; and (g) a rigid planar grid pivotably secured to the frame to pivot onto the upper surface of the top members when in assembly position, the grid being provided with holes positioned to constitute the securing means pattern and of a diameter sufficient to receive and pass a head of a securing or nail for the top and transverse members.

12. A jig according to claim 11 wherein the grid is pivotably secured to one of the jaws.

* * * * *